US008226819B2

(12) United States Patent
Goliaszewski et al.

(10) Patent No.: US 8,226,819 B2
(45) Date of Patent: Jul. 24, 2012

(54) SYNERGISTIC ACID BLEND EXTRACTION AID AND METHOD FOR ITS USE

(75) Inventors: Alan E. Goliaszewski, Hockessin, DE (US); Cato R. McDaniel, The Woodlands, TX (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/091,220

(22) Filed: Apr. 21, 2011

(65) Prior Publication Data

US 2011/0192767 A1 Aug. 11, 2011

Related U.S. Application Data

(62) Division of application No. 12/037,660, filed on Feb. 26, 2008, now Pat. No. 7,955,522.

(51) Int. Cl.

| | |
|---|---|
| ***C10G 17/02*** | (2006.01) |
| ***C10G 17/00*** | (2006.01) |
| ***C10G 17/08*** | (2006.01) |
| ***C09K 3/32*** | (2006.01) |

(52) U.S. Cl. ..... 208/252; 252/79.4; 252/189; 252/193; 252/364; 252/384; 252/406; 252/182.17; 252/182.28; 252/184; 208/311

(58) Field of Classification Search ..... 252/79.4, 252/184, 189, 193, 384, 406, 182.17, 182.28; 208/252, 311

See application file for complete search history.

(56) References Cited

U.S. PATENT DOCUMENTS

| | | | | |
|---|---|---|---|---|
| 1,941,267 | A | | 12/1933 | Morrell |
| 2,602,770 | A | | 7/1952 | Johnson et al. |
| 3,231,632 | A | | 1/1966 | Friedli et al. |
| 3,864,419 | A | | 2/1975 | Murphy |
| 4,209,385 | A | | 6/1980 | Stover |
| 4,623,444 | A | | 11/1986 | Che et al. |
| 4,778,589 | A | * | 10/1988 | Reynolds ..... 208/252 |
| 4,789,463 | A | * | 12/1988 | Reynolds ..... 208/252 |
| 4,985,139 | A | | 1/1991 | Madgavkar |
| 5,078,858 | A | * | 1/1992 | Hart et al. ..... 208/252 |
| 5,080,779 | A | * | 1/1992 | Awbrey et al. ..... 208/252 |
| 5,282,959 | A | | 2/1994 | Roling et al. |
| 5,593,573 | A | | 1/1997 | Kramer |
| 5,637,223 | A | * | 6/1997 | Bellos et al. ..... 210/639 |
| 5,672,578 | A | | 9/1997 | Carrie et al. |
| 5,795,463 | A | | 8/1998 | Prokopowicz |
| 5,912,219 | A | | 6/1999 | Carrie et al. |

(Continued)

FOREIGN PATENT DOCUMENTS

JP 09087109 3/1997

(Continued)

OTHER PUBLICATIONS

International Search Report and Written Opinion mailed Jun. 4, 2009 for PCT/US2009/034239 filed Feb. 17, 2009.

(Continued)

*Primary Examiner* — Joseph D Anthony
(74) *Attorney, Agent, or Firm* — Wegman, Hessler & Vanderburg

(57) ABSTRACT

An extraction aid has been found which provides for enhanced contaminate removal, such as metals and amines, from crude oils that uses components that are desirable in desalting processes as the components are water soluble, have low toxicity, are highly biodegradeable and exhibit high thermal stability. According to one embodiment of the invention, an extraction aid that provides enhanced extraction properties is comprised of a blend of acids, particularly water soluble acids. More specifically, a combination of two acids chosen from the group consisting of acetic acid, sulfuric acid, glycolic acid, citric acid and methanesulfonic acid.

7 Claims, 2 Drawing Sheets

U.S. PATENT DOCUMENTS

| | | | | |
|---|---|---|---|---|
| 6,905,593 | B2 * | 6/2005 | Kuehne et al. | 208/251 R |
| 7,955,522 | B2 * | 6/2011 | Goliaszewski et al. | 252/184 |
| 2002/0035306 | A1 | 3/2002 | Gore et al. | |
| 2004/0045875 | A1 * | 3/2004 | Nguyen et al. | 208/251 R |
| 2006/0174912 | A1 * | 8/2006 | Emami et al. | 134/1.3 |
| 2007/0062849 | A1 * | 3/2007 | Luo et al. | 208/251 R |
| 2010/0163457 | A1 * | 7/2010 | Subramaniyam | 208/252 |
| 2011/0068049 | A1 * | 3/2011 | Garcia et al. | 208/252 |

FOREIGN PATENT DOCUMENTS

| | | | |
|---|---|---|---|
| JP | 2004263074 | A | 9/2004 |
| KR | 1020000040470 | A | 7/2000 |

OTHER PUBLICATIONS

International Preliminary Report on Patentability mailed Aug. 31, 2010 for PCT/US2009/034239 filed Feb. 17, 2009.

* cited by examiner

SYNERGISTIC ACID BLEND EXTRACTION AID AND METHOD FOR ITS USE

CROSS-REFERENCE TO RELATED APPLICATIONS

This application is a divisional application and claims the priority filing benefit of U.S. patent application Ser. No. 12/037,660 filed Feb. 26, 2008.

FIELD OF THE INVENTION

The present invention relates to extraction aids, and the use of them in refinery desalting processes. More particularly, it relates to extraction aids used to remove contaminants, particularly metals and amines, from crude oils during refinery processes.

BACKGROUND OF THE INVENTION

Liquid hydrocarbon mediums, such as crude oils and crude fractions, including naphtha, gasoline, kerosene, jet fuel, fuel oil, gas oil and vacuum residuals, often contain contaminants that can be deleterious to either refinery processing or product quality. The contaminants can contribute to corrosion, heat exchanger fouling, furnace cooking, catalyst deactivation and product degradation in refinery and other processes. The contaminants are broadly classified as salts, bottom sediment and water, solids and metals. The amounts of these impurities vary depending upon the particular crude and its processing.

Desalting is a process that is used to remove contaminants, primarily inorganic salts, from crude oils prior to refining. The desalting step is provided by adding and mixing with the crude a few volume percentages of fresh water to contact brine and salt. Desalting provides benefits to the processing or refining of crude oils, including, reducing crude unit corrosion; reducing crude preheat system fouling; reducing the potential for distillation column damage; reducing energy costs; and reducing downstream process and product contamination.

In crude oil desalting, an emulsion of water in oil is intentionally formed with the water admitted being on the order of about four (4) to about ten (10) percent by volume based on the crude oil. Water is added to the crude and mixed intimately to transfer the impurities in the crude to the water phase. Separation of the phases occurs due to coalescence of the small water droplets into progressively larger droplets and eventual gravitational separation of the oil and underlying water phase.

In U.S. Pat. No. 4,778,589, a process is disclosed for the removal of metal contaminants, particularly calcium, from hydrocarbonaceous feedstocks. The process comprises mixing the feedstock with an aqueous solution of a metals sequestering agent, particularly hydroxycarboxylic acids, and more particularly, citric acid, then salts or mixtures thereof, and separating the aqueous solution containing the metals form the de-metalated feedstock.

U.S. Pat. No. 5,078,858, discloses and claims methods for extracting iron species, such as iron naphthenate and iron sulfides from a liquid hydrocarbon, such as crude oil. A chelant selected from the group consisting of oxalic or citric acid is added directly to the liquid hydrocarbon and mixed therewith. The wash water is added to form a water in oil emulsion, the emulsion is resolved, and the iron laden aqueous phase is separated.

In US Patent Application Publication No. US 2004/0045875 A1, it was found that metals and/or amines can be removed or transferred from a hydrocarbon phase to a water phase in an emulsion breaking process by using a composition that contains water-soluble hydroxyacids. The composition may also include at least one mineral acid to reduce the pH of the desalter wash water. A solvent may be optionally included in the composition. The process permits transfer or metals and/or amines into the aqueous phase with little or no hydrocarbon phase under-carry into the aqueous pHs.

Accordingly, a need still exists for a process that would show an improvement over the extraction of the contaminants in the crude oils such that the contaminants are not partitioned into the crude in the desalting process, using components that are water soluble, do not result in acids in the crude unit overhead that can raise neutralizer demand, are stable at high temperatures and that are easy to implement.

SUMMARY OF THE INVENTION

An extraction aid has been found which provides for enhanced contaminate removal, such as metals and amines, from crude oils that uses components that are desirable in desalting processes as the components are water soluble, have low toxicity, are highly biodegradeable and exhibit high thermal stability.

According to one embodiment of the invention, an extraction aid that provides enhanced extraction properties is comprised of a blend of acids, particularly water soluble acids. More specifically, a combination of two acids chosen from the group consisting of acetic acid, sulfuric acid, glycolic acid, citric acid and methanesulfonic acid.

An alternate embodiment showing synergistic effects in extraction is comprised of methanesulfonic acid (MSA) and citric acid, the combination of that has been found to perform better than the use of a single acid, such as citric acid.

In a further alternative embodiment of the invention, it was found by exploration, that the synergistic effect of the combination of methanesulfonic acid and citric acid was evident when methanesulfonic acid is present at levels of from about 5 to about 50% by volume of the extraction aid. Synergistic effects appear to be at a maximum at when methanesulfonic acid is present in the extraction aid at a level of between about 10 and about 20% by volume.

The various features of novelty that characterize the invention are pointed out with particularity in the claims annexed to and forming a part of this disclosure. For a better understanding of the invention, its operating advantages and benefits obtained by its uses, reference is made to the accompanying drawings and descriptive matter. The accompanying drawings are intended to show examples of the invention. The drawings are not intended as showing the limits of all of the ways the invention can be made and used. Changes to and substitutions of the various components of the invention can of course be made. The invention resides as well in sub-combinations and sub-systems of the elements described, and in methods of using them.

DETAILED DESCRIPTION OF THE INVENTION

Figure 1:
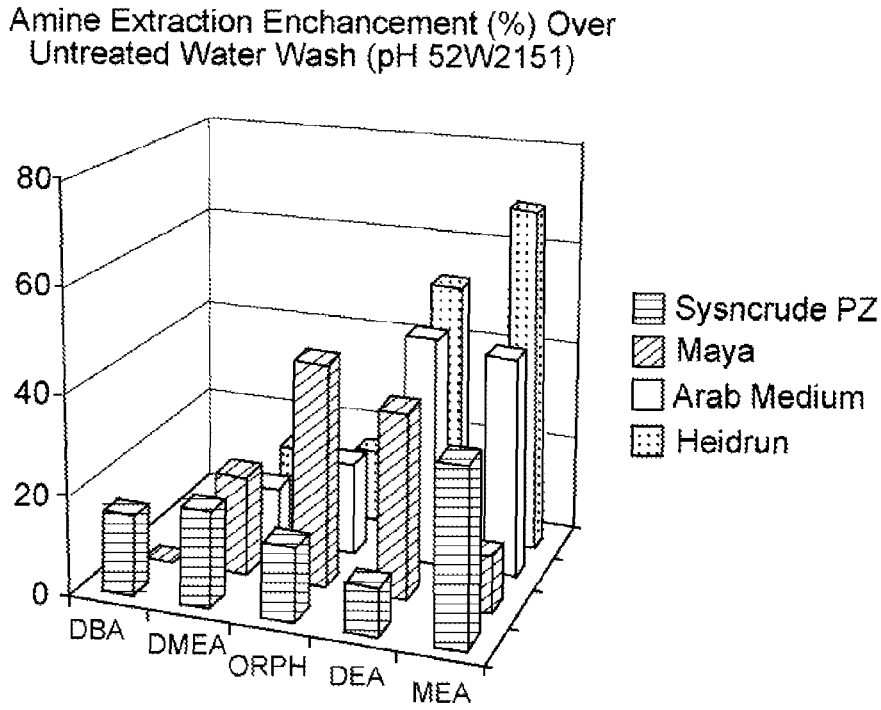
FIG. 1 is a graphic display of enhanced amine extraction vs. untreated waste water according to an embodiment of the present invention.

Approximating language, as used herein throughout the specification and claims, may be applied to modify any quantitative representation that could permissibly vary without resulting in a change in the basic function to which it is related. Accordingly, a value modified by a term or terms, such as "about", is not limited to the precise value specified. In at least some instances, the approximating language may correspond to the precision of an instrument for measuring the value. Range limitations may be combined and/or interchanged, and such ranges are identified and include all the sub-ranges included herein unless context or language indicates otherwise. Other than in the operating examples or where otherwise indicated, all numbers or expressions referring to quantities of ingredients, reaction conditions and the like, used in the specification and the claims, are to be understood as modified in all instances by the term "about".

As used herein, the terms "comprises," "comprising," "includes," "including," "has," "having" or any other variation thereof, are intended to cover a non-exclusive inclusion. For example, a process, method, article or apparatus that comprises a list of elements is not necessarily limited to only those elements, but may include other elements not expressly listed or inherent to such process, method article or apparatus.

According to one embodiment of the invention, an extraction aid, that provides enhanced extraction properties, for removing contaminants from crude oil during the desalting process in oil refining is comprised of a blend of acids, particularly water soluble acids. It has been found that the addition of a combination of acids to a crude oil can significantly reduce the amount of calcium and other metals and the amount of amines in the hydrocarbon when it is run through a desalter in a refinery. The combination of acids has been found to reduce the contaminants, particularly metal and amine contaminants, in the hydrocarbon at a higher level than a single acid alone when used as an extraction aid.

Various chemical species that enter a refinery with crude oil can be deleterious to either processing or product quality. One such group or chemical entity is the family of amines. Depending on relative boiling points, certain alkyl amines for instance, can remain in the crude oil after desalting and distill up the atmospheric tower. HCl salts of these amines can lead to deposition and to very aggressive under-deposit corrosion or molten salt corrosion. Rates of greater than 1000 mpy (mils per year penetration of corrosion) have been identified. This becomes particularly problematic if the salt point of the amine HCl salt is located in the tower top or draw lines, ahead of the water dew point. The sources of amines are many and include amines from an acid gas scrubbing unit, blowdown or leaks. It is also possible that amines enter the crude tower by virtue of coming from the desalter wash water and partitioning into the crude in the desalter. Amines which are present and demonstrate these characteristics, and which are significantly reduced by the addition of the extraction aid are known in the industry, and include but are not limited to, ethanolamine, diethanolamine, triethanolamine, N-methylethanolamine, N,N-dimethylethanolamine, morpholine, N-methyl morpholine, ethylenediamine, methoxypropylamine, N-ethyl morpholine, N-methyl ethanolamine, N-methyldiethanolamine, dibutylamine, and combinations thereof.

Another chemical species that are not desirable in the processing of crude oils and lead to problems are metals. It is intended that metals referred to in this invention included, but are not limited to, those Groups IA, IIA, VB, VIII, IIB and IVA of the Periodic Table (CAS version). In another, non limiting embodiment, the metals include, but are not limited to calcium, iron, zinc, silicon, nickel, sodium, potassium, vanadium and combinations thereof. Metals that are not extracted from the oil in the desalter, for instance, iron, may end up in the bottoms of the atmospheric distillation and in the coke made from these bottoms. This results in coke which is off specification for metals. Residual calcium can cause coker furnace fouling, drive residual fuel off specification for metal content or act as a catalyst poison in FCC feeds.

The desalting process in general is used as a means to remove undesirable species from crude oil. Water washing alone can extract some contaminants, including some metals and amines. Acids in general can assist with the removal of contaminants, particularly amines, by protonating the amines and making them more soluble in water. The beneficial effect of the acids is pronounced with the use of hydrophilic amines. An extraction aid that provides enhanced extraction properties is comprised of a blend of acids, particularly water soluble acids. More specifically, a combination of two acids chosen from the group consisting of acetic acid, sulfuric acid, glycolic acid, citric acid and methanesulfonic acid.

Acids that are water soluble are preferred, particularly citric acid, which not only exhibits water solubility but is also not soluble in hydrocarbons, and therefore does not result in acids remaining or entering the crude unit overhead. Such an action would result in the need to raise the amount of neutralizer. Citric acid ($C_6H_8O_7$) is a weak organic acid, with a water solubility of 133 g/100 ml (20° C.), and is not soluble in hydrocarbons, and is environmentally benign, and is therefore a preferred acid.

Methanesulfonic acid ($CH_3SO_2OH$), is a member of the sulfonic acid family, and is an organic acid. It is water soluble, but not soluble in hydrocarbons, exhibits stability at high temperatures and is biodegradeable.

By combining two acids to create an extraction aid, synergistic effects are exhibited on the extraction of contaminants from crude oils, particularly with respect to the extraction of metals, such as but not limited to iron and zinc, and amines. The synergistic value of the combined acids varies according to the composition of the extraction aid. Synergistic effects are exhibited in extraction aids that are comprised of from about 5 to about 50% by volume of methanesulfonic acid, with the second acid comprising citric acid. One embodiment of the invention comprises an extraction aid comprising methansulfonic acid and citric acid, wherein the methanesulfonic acid comprises from about 10 to about 20% by volume methanesulfonic acid.

Synergistic effects are seen with the combined acid extraction aid when compared to wash water alone, or a single acid extraction aid, such as citric acid. In an embodiment wherein methanesulfonic acid and citric acid are combined in an extraction aid, extraction enhancements are seen from up to about 70% over untreated wash water. The average extraction enhancement in such an embodiment is from about 20 to about 40% over untreated wash water. These synergistic effect is seen over a variety of crude oils, which exhibit a variety of contaminants, including various amines Examples of such crude oils include, but are not limited to Syncrude PZ, Maya, Arab Medium and Heidrun. The synergistic effect also varies in relation to different amines, such as dibutylamine (DBA), dimethylethanoamine (DMEA), morpholine (MORPH), diethanolamine and (DEA), and monoethanolamine (MEA).

Synergistic effects are also exhibited by the use of an extraction aid comprised of methanesulfonic acid and citric acid, over the use of an extraction aid comprised of only one acid, such as citric acid. This is particularly true with respect to the extraction of amines, and even more so with respect to polar amines.

EXAMPLE

Desalter simulations were performed using five industry relevant amines, DBA, DMEA, MORPH, DEA and MEA, in several crude oils of varying properties, in particular the crudes were Syncrude PZ, Maya, Arab Medium and Heidrun. The crudes were dosed with 200 ppm of the amines, a laboratory desalter simulation was conducted with treated and untreated wash water. The process used 4-8% wash water at from 240 to 300° F., with added shear. The results are displayed in the following chart.

| Sample | DBA ppm | DMAE ppm | MORPH ppm | DEA ppm | MEA ppm |
|---|---|---|---|---|---|
| Syncrude - tap water | 135 | 80 | 80 | 59 | 40 |
| Syncrude - pH 5 with citric acid | 104 | 65 | 68 | 66 | 26 |
| Syncrude - pH 5 citric acid/MSA (4:1) | 124 | 66 | 70 | 14 | 7 |
| Heidrun - tap water | 100 | 80 | 75 | 48 | 26 |
| Heidrun - pH 5 with citric acid | 129 | 70 | 64 | 23 | 8 |
| Heidrun - pH 5 citric acid/MSA (4:1) | 115 | 70 | 68 | 47 | 22 |
| Maya - tap water | 119 | 70 | 80 | 30 | 18 |
| Maya - pH 5 with citric acid | 128 | 90 | 98 | 40 | 34 |
| Maya - repeat at pH 5 (citric) | 124 | 37 | 45 | 19 | 16 |
| Maya - pH 5 citric acid/MSA (4:1) | 144 | 47 | 49 | 13 | 6 |
| Arab Med - tap water | 148 | 90 | 95 | 37 | 27 |
| Arab Med - pH 5 with citric acid | 176 | 100 | 77 | 20 | 15 |
| Arab Med - pH 5 citric acid/MSA (4:1) | 162 | 69 | 58 | 16 | 7 |

Figure 2:
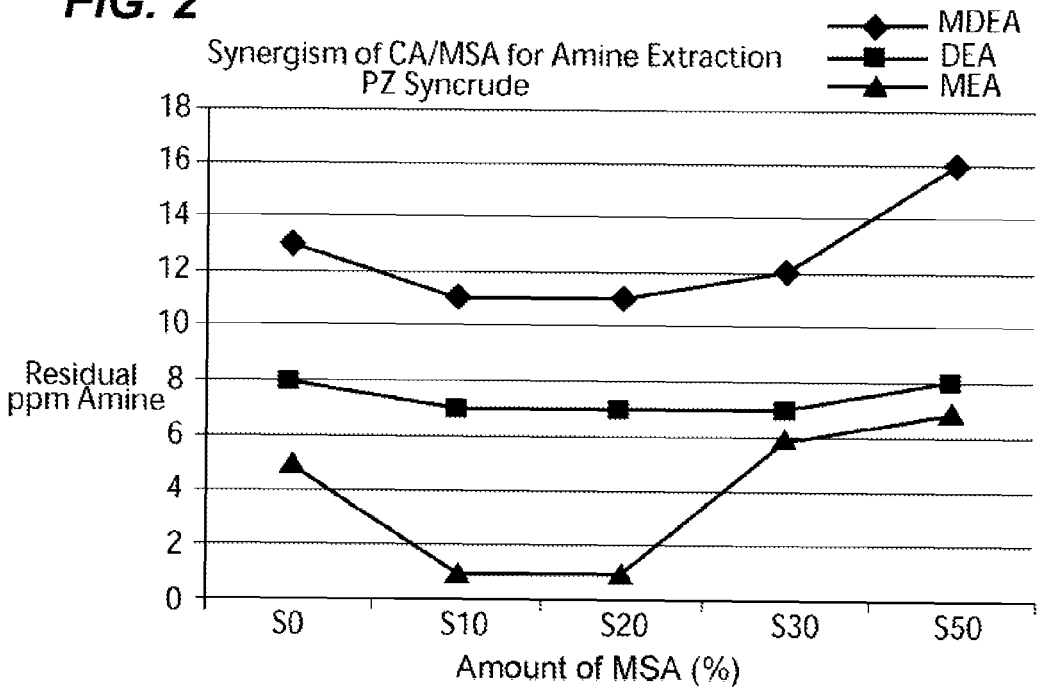
FIG. 2 is a graph displaying synergy from the combined acid extraction aid according to an embodiment of the present invention.
Figure 3:
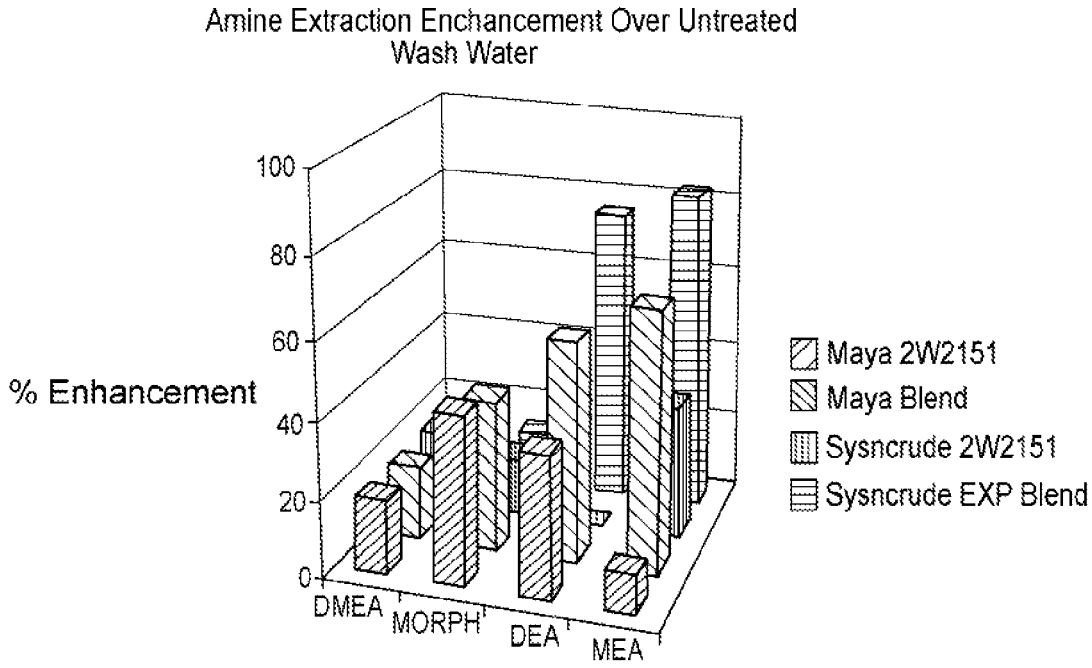
FIG. 3 is a graph displaying enhanced amine extraction vs. a citric acid extraction aid according to an embodiment of the present invention.

The percentage of amine extraction enhancement over untreated wash water is shown in accompanying FIG. 1, while FIG. 3 shows the enhanced extraction over an extraction aid with a single acid, specifically citric acid. FIG. 2 displays the synergy of the combined acids according to the present invention. While the present invention has been described with references to preferred embodiments, various changes or substitutions may be made on these embodiments by those ordinarily skilled in the art pertinent to the present invention with out departing from the technical scope of the present invention. Therefore, the technical scope of the present invention encompasses not only those embodiments described above, but all that fall within the scope of the appended claims.

What is claimed is:

1. A process for reducing contaminants during a desalting process in a crude oil refinery comprising:

(a) providing an extraction aid, wherein said extraction aid consists of methanesulfonic acid and citric acid;

(b) providing a crude oil stream; and (c) mixing said extraction aid with said crude oil stream.

2. The process of claim 1 wherein said methanesulfonic acid is present in an amount ranging from about 5 to about 50% by volume of said extraction aid.

3. The process of claim 2 wherein said methanesulfonic acid is present in an amount ranging from about 10 to about 20% by volume of said extraction aid.

4. The process of claim 1, wherein said contaminants comprise metals and amines.

5. The process of claim 1, wherein said process further comprises an aqueous stream and mixing said aqueous stream with said crude oil stream and said extraction aid.

6. The process of claim 5, wherein said aqueous stream is present in an amount of from about 1 to about 10% by volume of said crude oil stream.

7. The process of claim 6, wherein said aqueous stream is present in an amount of from about 4 to about 8% by volume of said crude oil stream.

* * * * *